US005979074A

United States Patent [19]

Brunner et al.

[11] Patent Number: 5,979,074

[45] Date of Patent: Nov. 9, 1999

[54] METHOD AND DEVICE FOR DRYING SAWN TIMBER AT REDUCED PRESSURE

[76] Inventors: Reinhard Brunner; Kal Brunner, both of Vorwerkstrasse 9, 30989 Gehrden, Germany

[21] Appl. No.: 08/973,909

[22] PCT Filed: Jun. 10, 1996

[86] PCT No.: PCT/DE96/01066

§ 371 Date: Apr. 6, 1998

§ 102(e) Date: Apr. 6, 1998

[87] PCT Pub. No.: WO97/00412

PCT Pub. Date: Jan. 3, 1997

[30] Foreign Application Priority Data

Jun. 17, 1995 [DE] Germany ..... 195 22 028

[51] Int. Cl.[6] ..... F26B 7/00

[52] U.S. Cl. ..... 34/396; 34/469; 34/471

[58] Field of Search ..... 34/396, 411, 469, 34/471, 535, 552, 76, 92, 210, 212, 213, 215, 218

[56] References Cited

U.S. PATENT DOCUMENTS

| | | | |
|---|---|---|---|
| 4,194,296 | 3/1980 | Pagnozzi et al. | 34/410 |
| 4,862,599 | 9/1989 | Brunner | 34/536 |
| 5,197,201 | 3/1993 | Salin | 34/209 X |
| 5,228,209 | 7/1993 | Brunner | 34/417 |
| 5,425,182 | 6/1995 | Brunner | 34/66 |

*Primary Examiner*—Henry Bennett
*Assistant Examiner*—Steve Gravini
*Attorney, Agent, or Firm*—Lackenbach Siegel Marzullo & Aronson

[57] ABSTRACT

This invention relates to a process and an apparatus to dry cut timber or other hygroscopical plate-shaped or bar-shaped goods in subatmospheric pressure in a vacuum-solid drying chamber, which is equiped with ventilators (fans) effecting crosswise to the length axis of the chamber to revolve a gaseous drying medium, with one or several heating coils extending over the length of the chamber, and with a dehumidifying device (condenser). It is task of the invention to regulate the heat energy supply for individual stack areas and thus the removal of humidity contained in the wood, independent of other stack areas of the same charge in the drying chamber. Thereby, existing or arising dispersions of the wood moisture in different stack areas due to inhomogeneous conditions inside and outside the drying chamber, ought to be eliminated during the drying stage before entering the final equalizing and conditioning stage.

17 Claims, 4 Drawing Sheets

METHOD AND DEVICE FOR DRYING SAWN TIMBER AT REDUCED PRESSURE

Figure 1:
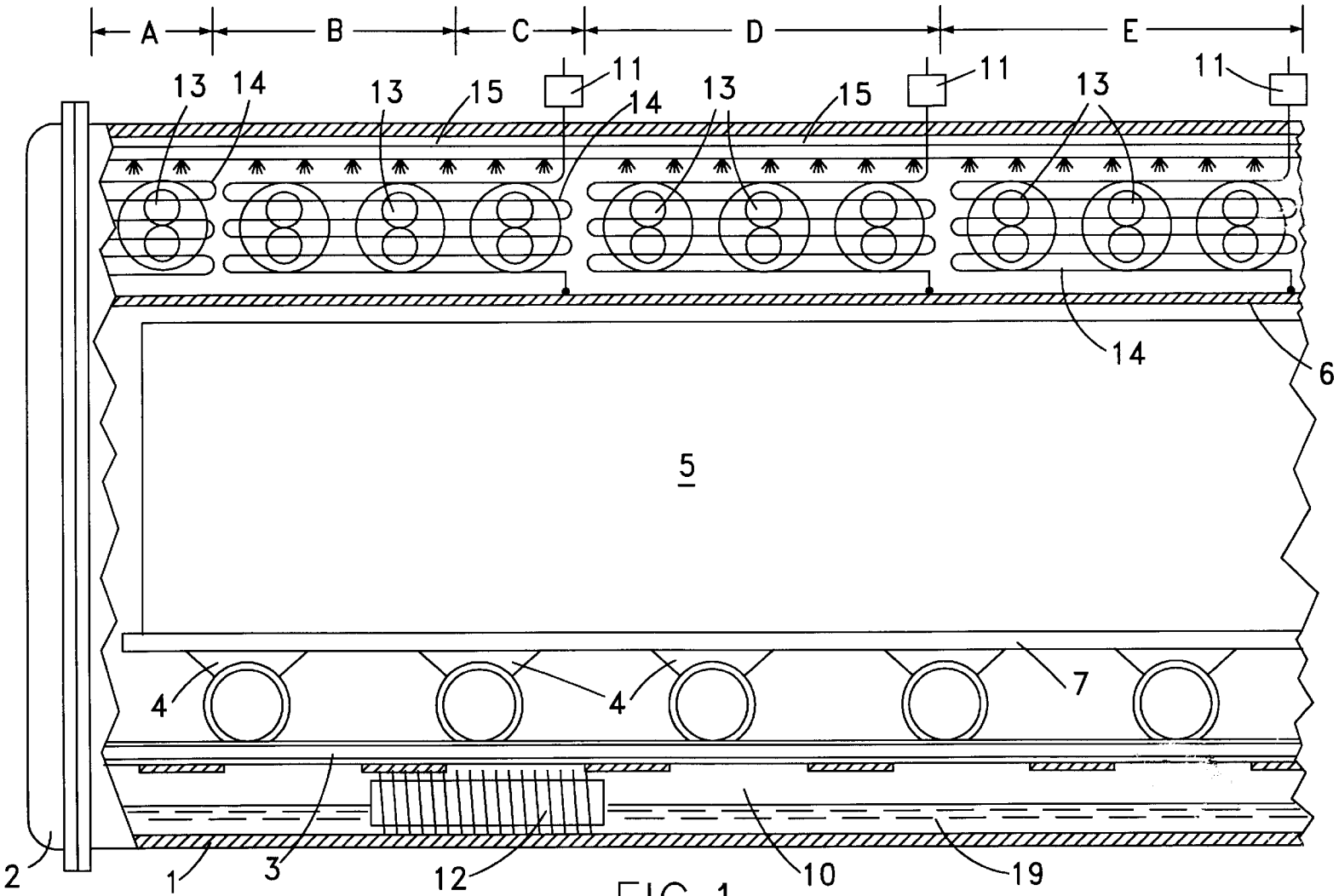

The invention relates to a process and an apparatus for drying cut timber or other hygroscopical plate-shaped or bar-shaped goods in a vacuum, stacked with intermediate bars ("stickers") in a vacuum-solid chamber, which is equiped with ventilators (fans) whose effect in direction extends crosswise to the longitudinal axis of the drying chamber to revolve a gaseous drying medium, with one or several heating units (heating coils) that extend along the length of the drying chamber (kiln), and with a dehumidifying device (condenser) inside or outside the drying chamber.

The vacuum drying in a rough vacuum offers a possibility for considerably shorten drying time compared with conventional technical drying in atmospheric pressure. The mobility of water inside the wood rises generally in parallel to decreasing pressure, so that the drying process accordingly can be accelerated without resulting in any mechanical tensions (stresses) in the wood due to overdried surface with a wet core (so called "case hardening") that can lead to crack building or deformation.

To shorten the drying time it is required that the evaporation heat needed is transferred faster from the heating coils to the wood. This is not that easy to achieve in vacuum with convective heat transfer, since the heat capacity of the drying medium (the heat energy carrier) reduces proportionally to decreasing pressure. Consequently, compared to conventional drying a significant higher flow velocity of the drying medium has to be produced, in order to be able to transport sufficient energy per time unit.

In order to avoid too high an investment and operating costs as a consequence of fan capacity installed, increased abrasion and electrical energy consumption, the flow velocity is usually not extended up to the required maximum value. Therefore, the transfer of evaporation heat in particular to fast drying softwood in the beginning of drying with still a lot of light moving free water in the spaces between wood cells, in general shows a short supply which determines the drying progress more than the other parameters.

Keeping an important quality characteristic of the drying process (low dispersion of the final wood moisture content) causes problems in vacuum drying. In practice, especially very big volume kilns often are loaded with varied timber batches, with green and with predried ware, for example after storing under roof in the open air. The existing difference of the wood moisture of an individual stack or part of a stack at the beginning, whereat also differences in length direction of the boards can occur, remains nearly the same by homogeneous drying conditions. Low final moisture dispersion without additional steps in a long conditioning and equalizing stage, is achieved only if the initial dispersions were not too high.

This problem arises during conventional drying only to a small extent. This can be explained as follows: With atmospheric pressure and drying temperature below 100° C., humidity removal occurs by evaporation at the wood surface and diffusion into the drying medium (steam-air-mixture) that supplies in its part the required evaporation energy. For wood moisture content below fibre saturation point, when the wood shows hygroscopical characteristics, the drying force at given temperature and air velocity is determined by the so called "drying gradient"=wood moisture content (MC)/equilibrium moisture content (EMC). At a climate held constant (this means constant EMC) the drying gradient for the most humid timber-batch is the highest one. This is drying accordingly quicker, so that initial existing moisture differences at homogeneous flow of drying medium through the stacks balance out automatically during the drying process without any special steps.

In the vacuum drying there exists this self-regulating mechanism under normal conditions only to a small extent. As long as the total pressure in the drying chamber is below the water steam saturation pressure (dependent on temperature; it has the same meaning as to exceed the boiling point temperature), humidity can evaporate without hindrance by diffusion process, if only the required heat energy is supplied. The actual wood moisture has only small influence to the humidity discharge per time unit, so that the wood moisture of all batches decreases in almost the same scale and the existing differences do not disappear. The remaining differences have to be reduced to permitted values in the equalizing stage with additional time and energy consumption.

The described effect is particularly evident in "hot steam" vacuum drying with unsaturated water steam as the drying medium (without significant parts of external gas), since the steam pressure cannot exceed the saturation pressure at a given temperature. "Hot steam" drying is preferred in practice for example always in that case, if wood discoloration subjected to oxidation should be avoided, or if there exists the risk of mould rising.

Another effect being of less importance in conventional drying, is a result of local temperature variations in individual chamber areas. In a vacuum, already low deviations of for example ±1° C., resulting in changes of relative steam pressure in accordance with the phase diagram of water, have considerable influence to drying rate, that is again more important in pure hot steam. The influence is the more significant the quicker the dehumidifying works, so particularly in the beginning of drying with wood moisture being high.

By this effect in vacuum drying, unequally distributed heat losses through well insulated outside walls are of special importance. Relative high heat loss usually arises in both end areas of the vacuum vessel, since the circulating drying medium touches a considerably larger outside wall surface than in other areas. Additionally, there is the effect of heat bridges, for example at door flange or pipes through the wall. However, nonhomogenity of the heat losses can also be produced by outside conditions, for example by unequal solar irradiation or wind. Local temperature variations also may occur by the nonhomogenity of the heat supply, for example because of dispersions of efficiency of heating coil parts or of the fans.

Another cause for nonhomogeneous drying is that incorrect or inprecise stacking that in practice for example with unedged (only two-sided cut) ware cannot be fully avoided. Moreover, timber length in the stacks is not always the same which can result in hollow spaces between adjacent stacks, that disturb the homogenity of drying medium flow. The effect of the uneven stacking to the drying process is obsered more evidently in a vacuum than in atmospheric pressure, analogous to the previously mentioned influences.

The regulation of the steam pressure or steam partial pressure occurs in the vacuum kiln usually by means of the cooling performance of the condenser. Strengthened cooling reduces the steam pressure by condensation; pressure increase occurs at the turned off cooling through the humidity coming out from the wood in the form of steam. In critical situations, if the steam generation by the wood is less than the condensation rate at the chamber outside wall that is not perfectly heat insulated, or if the heat supply at the wood has to be stopped because of other reasons, it can be necessary to produce additional steam to increase pressure.

Comparable steps in the conventional drying, spraying water or supplying steam, cause other effects, since the ratio of air partial pressure and steam partial pressure changes there, but not the total pressure.

The mentioned problems in achieving uniform final wood moisture contents in the stacks of a lumber charge that was loaded into the drying chamber with significant initial wood moisture differences, lead either to varied final moisture contents or to an increased energy and time consumption for equalizing the wood. Similar effects result from uneven distributed heat losses at the chamber walls, dependent on the construction of the kiln or on changing external conditions, or from inappropriate stacking, but also from nonhomogenity of the heat supply to the stacks.

This invention avoids the disadvantage of the state of the art. It is the task of the invention to regulate the heat energy supply to the individual stack areas and by that the humidity removal per time unit of the wood in these areas, independent on other areas of the same drying charge in the drying chamber. Thereby it should be achieved that wood moisture differences between stack areas have balanced out during the drying stage, before reaching the equalizing and conditioning stage, and that the occurance of additional moisture differences by nonhomogeneous heat losses through the chamber outer walls or by nonhomogeneous heat supply is prevented as well as possible.

Another task is that for vacuum drying with steam required, this steam can be produced in a cost-sparing way. Steam production may be very important for example during the preheating stage at the start of the drying process, if not properly predried and already "case hardened" timber batches are brought into the drying chamber, so that the required steam pressure cannot be achieved by humidity removal of the wood in appropriate time.

This invention resolves the task thereby that the drying chamber is divided preferrably in the direction of its length axis into at least two stack areas, and that the heat energy transfer from the heating coils is regulated in each individual area, dependent upon measured values of the drying medium temperature, of the wood moisture content and/or of the wood moisture gradient and/or of the wood temperature. An additional division into at least two stack areas in different height can contribute to solve the tasks in particular for very high stacks. In chambers with great height and small length, the height division alone would be sufficient to solve the set task.

In general, there will be left a possibility of transition of the drying medium between the individual drying areas.

A relative measure of the heat energy quantity transferred to any individual stack area can be obtained from temperature values of the drying medium before entering the stack and after leaving it.

The pressure in the drying chamber determining besides other parameters the humidity movement inside the wood, cannot be varied locally, just as the partial pressure of the present gas or steam. However, it was possible to find parameters, which allow to treat individually single stack areas of one charge in one and the same chamber in such a way, that in spite of initial moisture variations nearly the same final moisture in the whole charge will be obtained, or that influences to the drying process by heat bridges or by nonhomogeneous heat energy supply or by external conditions will be avoided.

The preferred division into stack areas can be achieved inventively by an equipment constituted in such a manner, that individual sections of the heating coils are equiped with separate valves to throttle or to block the heating agent.

An alternate equipment to achieve a division into stack areas consists in separately operating single fans or groups of adjacent fans by means of a controlling unit. Each fan or group of fans may be turned on and off in the course of time, independent of the other fans. An individual control of the speed of rotation may be applied too, if the required variable speed drive (frequency converter) investment cost is not objectionable.

The invention prefers a combined equipment, with two or several fans assigned to one heating coil section and controlled individually. Thereby, the average velocity of the drying medium can be adjusted up to a certain extent independent of the drying medium temperature.

This adjustment or regulation occurs dependent on the measured values of the wood moisture and/or the wood moisture gradient and/or the wood temperature, acquired by separate sensors in each stack area. Thereby, in many cases the heat transfer can be regulated only by use of the measured values of the drying medium temperature.

With the described characteristics, the task can be solved.

In this way, lumber with varied initial moisture can be dried in a vacuum kiln with relative low energy and time consumption, down to the desired final moisture with admissible dispersion, before entering the equalizing and conditioning stage. Moreover, the generation of wood moisture differences, caused by wood-specific or chamber-specific influences, by effects of the external world or by unexact stacking, can be avoided to a great extent.

The solution of the task, the invention is based on, yields the possibility to dry lumber of different species and thickness at the same time in the same charge without any loss of quality, if only drying characteristics are similar.

The practice of vacuum drying has given as a result that temperature and speed of drying medium currents generated by adjacent fans and being parallel and of the same direction, do not mix noticeably during a circulation in the chamber and the passage through the stack. Thus it is possible to get spatially separated drying areas with varied conditions of the drying medium, even without internal partition walls.

The quantity of the humidity removed per time unit is determined in vacuum by the transferred evaporation heat, so long as the humidity movement inside the wood is sufficient to maintain an adequate humidity transport from the wood core. The resulting wood moisture gradient between core and surface may not exeed a specific limit, in order that the wood is not stressed by case hardening.

According to the invention it is sufficient to regulate only the quantity of heating energy transfer, so far as the pressure is chosen so that for every stack area the appropriate humidity transport from the wood core is guaranteed. That can be checked if in all stack areas measuring sensors for the wood moisture gradient are mounted.

There one can proceed in a way that the heat supply for individual stack areas is adjusted by means of heating power of the heating coil parts spatially assigned. This adjustment may be performed by a controlling or regulating unit, preferrably based on a certain program.

Another or additional way is to adjust the heat supply by means of the speed of rotation and/or operation and break time and/or the number of operating fans, spatially assigned.

If along the width of a stack area, in the flow direction of the drying medium, deviated wood moisture arises at both stack sides, it is possible to reduce the deviation by varied treatment, such as by asymmetrically reversing the fans in the course of time, so that the drying medium is circulating for a longer time in one direction than in the other one. That side of the stack, which is preferred in time average to be the entering side for the drying medium, and it thus is supplied with more heat than the opposite side.

It can be alternatively or additionally advantageous to choose for either rotating direction another speed. With this step, characteristics subjected to the construction of traded fans that have in general no identical efficiency (conveying power dependent on the speed of rotation) for both rotating directions, can be compensated.

Kiln specific or external conditions can be recognized by the described influences through disturbance of the homogeneous temperature distribution mostly at high wood moisture at the beginning of drying and at lumber that is difficult to dry. In this stage existing wood moisture differences are of no importance. A uniform, quick drying progress can be achieved in this stage instead of by area specific regulation of the heat supply, also with homogeneous temperature distribution by mixing the drying medium of adjacent areas or in the entire chamber. For this aim, flow conducting baffles or additional fans are suitable, that cause drying medium flow in length direction of the chamber superimposing the main flow circulating perpendicular to it.

With the decrease of wood moisture content, conditions referred to in wood (for example moisture differences, exactness of the stacking) get an increasing importance; to continue mixing of the drying medium cannot contribute to solve the task anymore.

In a vacuum drier with equipment for steam generation inside or outside the chamber, it is not necessary for the individual drying treatment of each stack area to control individually the inflow of steam or fluid to be evaporated, since steam always disperses uniformly in the entire chamber, independent on the injection point or area. Thus, the steam is generated in the way that the vaporization fluid is sprayed on to the heating coils over the whole length of the chamber, disregarding more or less heated coil sections of the heating coils.

It is also advantageous if the fluid needed for evaporation is taken out from a reservoir of condensate which originated in the wood. Compared with alternatively available tap water there is saved up energy, because the condensate always exhibits a higher temperature level than tap water. It also needs no water softening to avoid calcareous deposit on the heat conducting fins of the heating pipes. Additionally the risk of spot rising on the timber surface decreases by applying condensate with wood specific contents.

The reservoir is not totally depleted at the end of a drying process, so that a condensate stock is available for the start of the next drying cycle.

It is appropriate to collect the nonvaporized remainder of the sprayed fluid and to lead it back to its reservoir. Thereby, a continued, uncontrollable vaporization in the range of the circulating drying medium is avoided.

For a vacuum dryer with external condenser that is connected via a hermetically sealed pipe with the drying chamber, the removal and returning of condensate enhances the expense in consequence of an additionally required pipe. Nevertheless, the quantity of condensate existing in the bottom region and resulting from steam condensation at the wall, especially at heat bridges, may be sufficient in general to generate the required steam, even for this type of vacuum dryer.

The possibility according to the invention, to dry cut timber stacked with intermediate bars in subatmospheric pressure in a vacuum-solid drying chamber, which is equiped with fans whose effect direction extends crosswise to the longitudinal axis of the chamber to revolve a gaseous drying medium, with a dehumidifying equipment (condenser) and with one or several heating coils that extend along the length of the drying chamber, is characterized by a drying chamber divided preferrably in a length axis direction and/or in a height direction in several stack areas, and that measuring sensors and controlling and/or regulating apparatus are assigned to each stack area, to adjust an individual heat energy supply for each stack area.

The device according to the invention divides the drying chamber preferrably in a direction of its length axis and/or its height in several stack areas, whereby this division is not achieved by more or less hermetic partition walls, retaining a possibility of pressure balancing by transition of the drying medium between the stack areas. The division is achieved rather by controlling fans and/or heating coils separately in different sections. For this selective controlling, measuring sensors and controlling and/or regulating apparatus are assigned to adjust an individual heat energy current to each of the stack areas.

Therefore it is appropriate that the heating coils consist of two or more sections having separate valves to throttle or to block the heating agent supply to any of the sections.

For a dryer with an evaporation device it is appropriate, if the fluid to be evoporated at the heating coils is fed to at least one pipe equipped with apertures, extending over the length of the chamber and mounted nearby the heating coils so, that they are sprinkled with the fluid if the steam pressure has to be increased.

With heating coils mounted above an the intermediate ceiling, the latter can be used to collect the remaining fluid. If the heating coils are mounted beside the stacks, the intermediate bottom can perform the same function.

For re-using the condensate originating in wood, as fluid to be evaporated and for the circulation of this fluid, it is advantageous, if the sprinkler pipe is connected with the condensate reservoir via a motor pump.

For the circulation of the vaporization fluid it is appropriate furthermore, if a collecting trough is disposed below the sprinkler pipe and the sprayed part of the heating coils, and if the trough has an aperture at its one end to let flow the remaining fluid back to the reservoir.

If the influence upon the individual drying processes is performed wholly or partly by means of the fans, it is necessary that at least one fan is designed for each drying area, and that there are controlling or regulation devices, which control the operation and break time and/or the speed of rotation of the fans separately in each drying area.

The individual controlling of the fans is accomplished preferrably by means of a central process computer.

Figure 2:
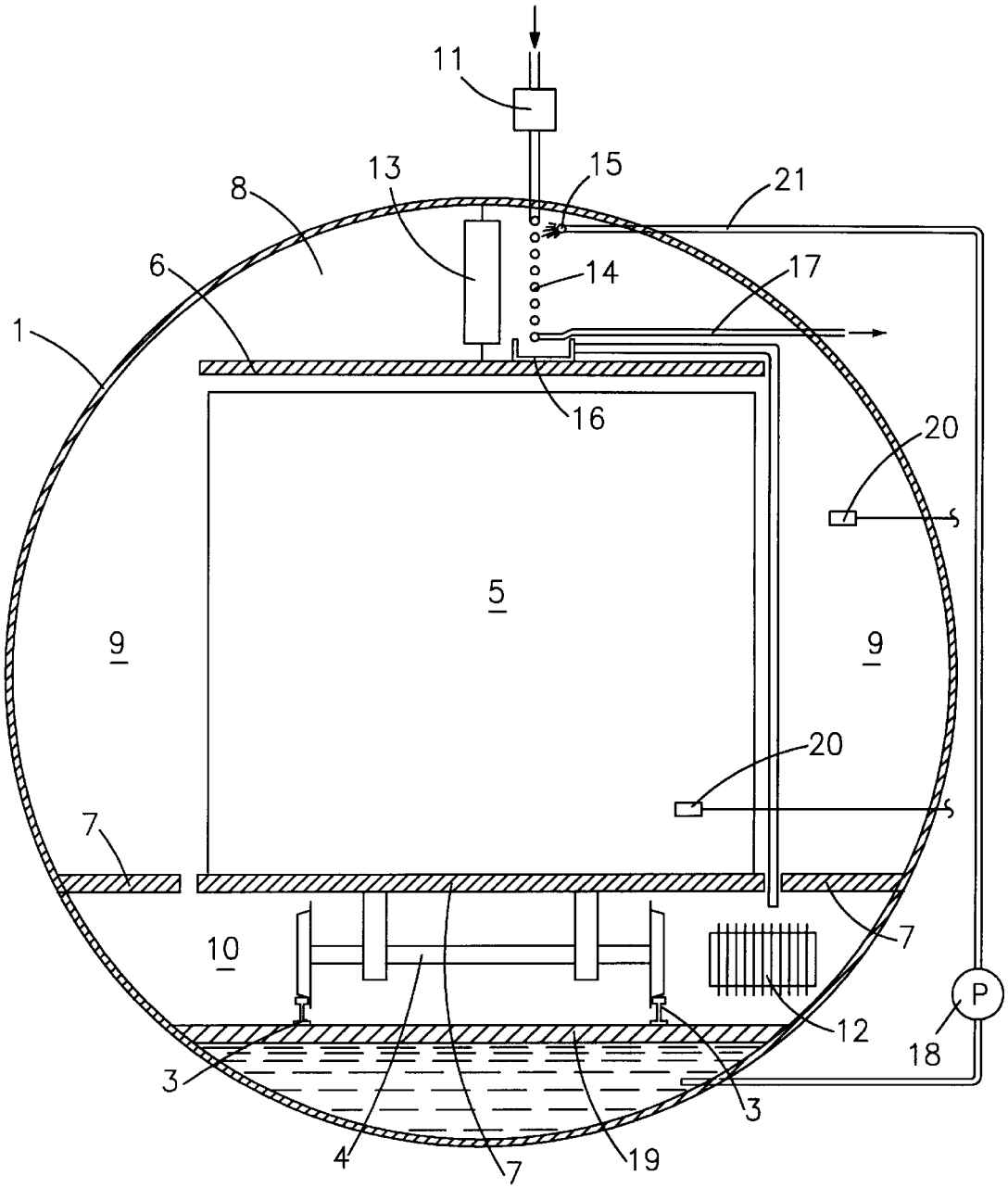
Figure 3:
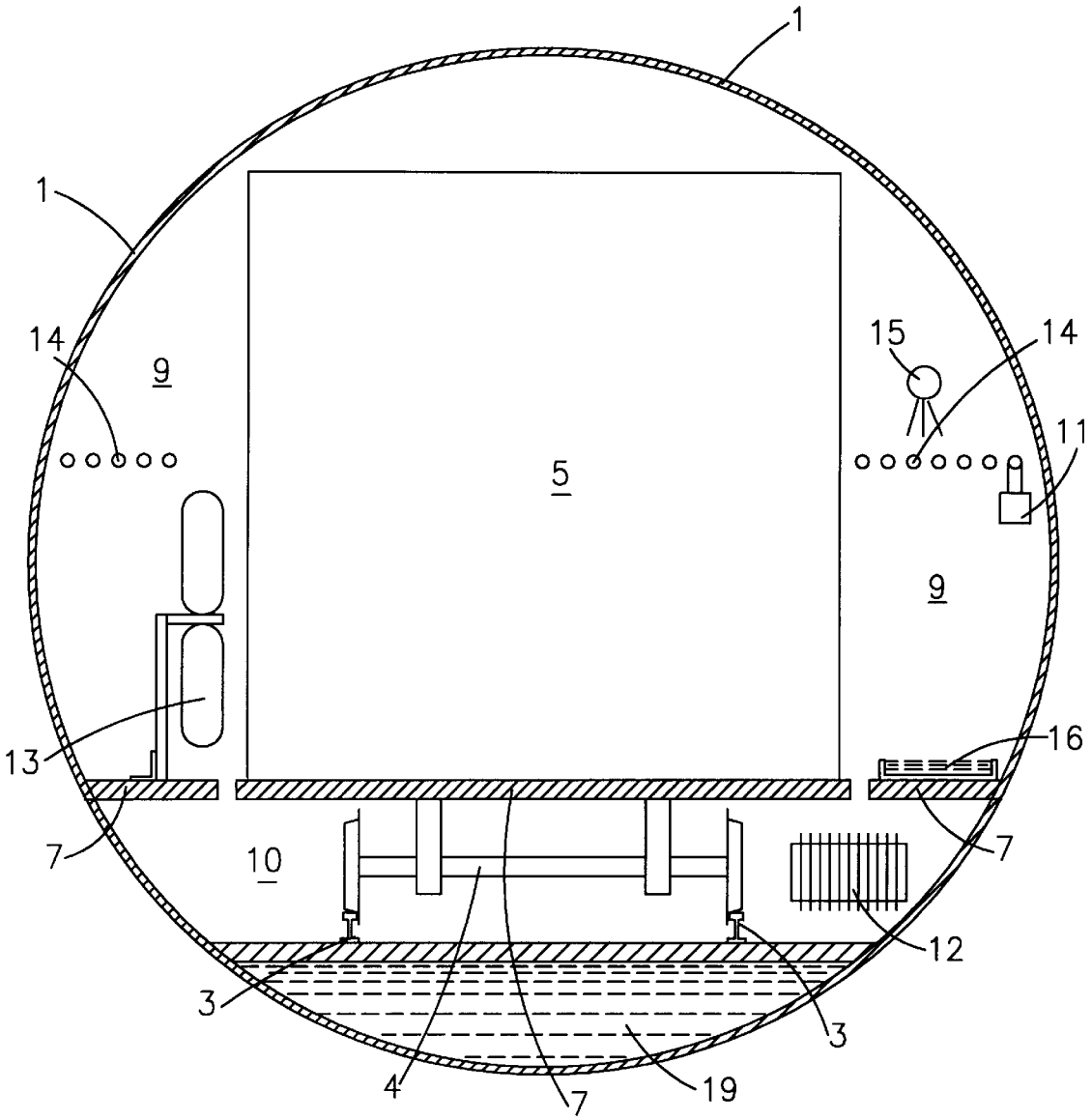
Figure 4:
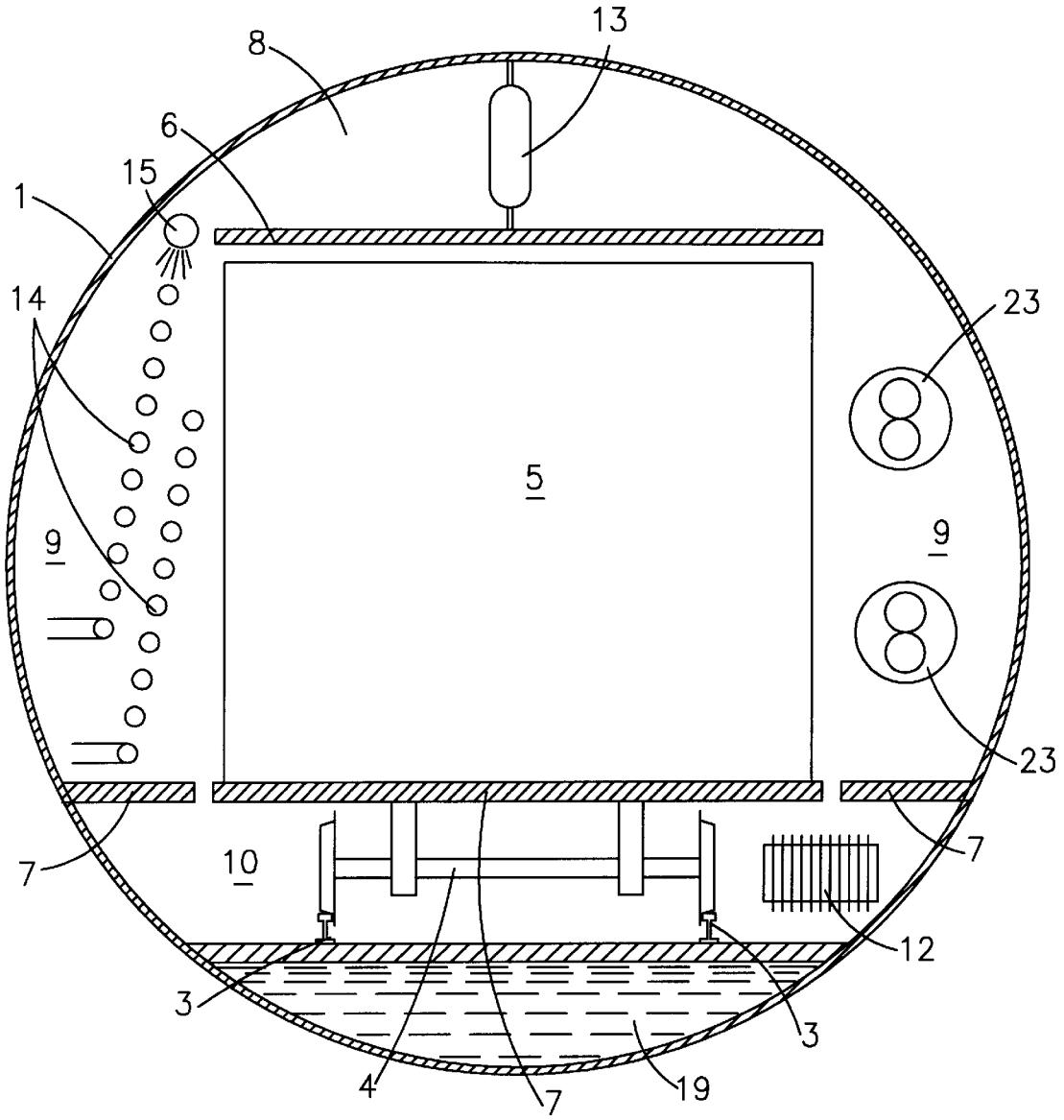

To explain the subject of the invention by way of examples of preferred embodiments, the schematic drawings show:

FIG. 1 a longitudinal section view of a vacuum kiln,

FIG. 2 a cross-sectional view of the same kiln,

FIG. 3 a cross-sectional view of another kiln,

FIG. 4 a cross-sectional view of a third kiln.

The vacuum-solid kiln shown in the drawings, destined for drying cut timber stacked with intermediate bars (not shown) in subatmospheric pressure, consists of a cylindrical vacuum vessel 1 with a door 2 at one end. In this vessel 1, tracks 3 for lorries 4 are mounted, carrying the cut timber stacks 5. Above the stack 5 there is an intermediate ceiling 6, below the stack an intermediate bottom 7 that is formed by the loading platform of the lorry 4 and at both sides by horizontal partitions adjoined with the vessel wall. Between these partitions and the platform of the lorry 4, there remain small spaces. The intermediate ceiling 6 extends from one end of the vessel 1 to the other end, its sides do not adjoin with the wall of the vessel, but let enough space for circulation of drying medium around the length axis of the vessel. The intermediate bottom 7 extends also from one to the other end of the vessel 1. The condensation room 10 below the intermediate bottom 7 is not separated hermetically from the drying room 9, so that parts of the drying medium can enter the condensation room 10 through the spaces on both sides of the platforms of the lorries 4. In this room 10 there is a condenser 12, the room 10 itself serves as a reservoir for the condensate 19 deposited by the condenser 12.

In the embodiment shown in FIG. 1 and 2, reversible fans 13 are installed in the room 8 above the intermediate ceiling 6 to revolve the gaseous drying medium. The interior room of the vessel 1 is devided into several drying areas A, B, C, D, E. A sprinkler pipe 15 extends generally parallel to the heating coil sections 14 along the vessel. By means of the valves 11 the power of the heating coil sections 14 is adjusted.

The fans 13 are fitted in equal distances above the intermediate ceiling 6. At least one fan is assigned to each drying area A to E.

Sensors 20 for measuring the wood moisture, the wood moisture gradient and the wood temperature are placed inside the stack 5. Other sensors 20 at one or both sides of the stack 5 are measuring the temperature of the drying medium.

Below the heating coils 14 and the sprinkler pipe 15, a trough 16 is placed for collecting nonevaporated vaporization fluid, a pipe 17 leads the remaining fluid into the room 10, serving as a reservoir for the vaporization fluid and condensate 19. From this reservoir, the fluid required for vaporization is taken out again and fed by means of a motor pump 18 into the sprinkler pipe 15.

In the example of FIG. 1 and 2, the heating coils are arranged in the room 8 in front of the reversible fans 13. The coils are supplied with heating agent via valves 11 and pipes 22.

Inside and outside the stack 5 in the room 9 there are measuring sensors 20 delivering the required actual values to the computer or controlling unit (not shown) for the regulation of the drying process.

In the example of FIG. 3 the heating coils 14 and the fans 13 are exposed beside the cut timber stack 5, whereby the flow of drying medium generated by the fan, is first going through the lower half stack and then back through the upper half or vice versa.

In the embodiment of FIG. 4, heating coil sections 14, individually supplied with the heating agent, are arranged one upon the other beside the stack 5. By this arrangement the stack can be divided into two height areas. Additional fans 23 that are not implicitly necessary, can generate a flow component of drying medium in the length direction of the vessel, if it is required.

| List of reference symbols: | |
|---|---|
| 1 | Vacuum vessel |
| 2 | Door |
| 3 | Tracks |
| 4 | Lorry |
| 5 | Cut timber stack |
| 6 | Intermediate ceiling |

-continued

| List of reference symbols: | |
|---|---|
| 7 | Intermediate bottom |
| 8 | Room above intermediate ceiling |
| 9 | Drying room |
| 10 | Condensation room and reservoir |
| 11 | Valve for heating agent |
| 12 | Condenser |
| 13 | Fan (ventilator) |
| 14 | Heating coils |
| 15 | Sprinkler pipe |
| 16 | Trough |
| 17 | Drain pipe for vaporization fluid |
| 18 | Pump for vaporization fluid (condensate) |
| 19 | Condensate |
| 20 | Measuring sensors |
| 21 | Supply pipe for vaporization fluid |
| 22 | Supply pipe for heating agent |
| 23 | Additional fan (ventilator) |
| A, B, C, D, E | Stack areas |

We claim:

1. Process for drying cut timber and other plate-shaped/bar-shaped goods in a vacuum, stacked with intermediate bars in a drying chamber, having a longitudinal axis which is provided with fans/ventilators whose effect in direction extends cross-wise to said longitudinal axis of said drying chamber so as to revolve a gaseous drying medium, and which is provided with a plurality of heating units that extend along the length of said drying chamber, and a dehumidifying device, comprising the steps of: separating/dividing said drying chamber in the direction of said longitudinal axis so as to form several stack areas, and transferring heat energy from said heating units to said several stack areas so as to regulate same individually for each said stack area based on measured values selected from the group consisting of the drying medium temperature, the wood moisture, the wood moisture gradient, the wood temperature and combinations thereof; and adjusting said transfer of heat energy applied to said several stack areas as desired.

2. Process according to claim 1, wherein the transfer of said heat energy is adjusted by varying power to the heating units assigned to each of said several stacked areas.

3. Process according to claim 1 wherein said heat energy for each of said several stack areas is adjusted by means selected from the group consisting of their speed of rotation, their operation/on time, and break/off time the number of fans in operation and combinations thereof.

4. Process according to claim 3, further including asymmetrically reversing said fans in the course of time in either direction of rotation, so that the drying medium is circulating for a longer time in one direction than the other direction whereby the heat transfer to a half stack area which is preferred in time averages to be an entrance side for said gaseous drying medium, and its flow is greater than that of the opposite half stack area.

5. Process according to claim 1, wherein said vacuum dryer chamber is provided with a steam producing device, and fluid to be evaporated is sprayed uniformly on to the heating units over generally the whole length of said drying chamber.

6. Process according to claim 5, wherein the fluid required for evaporation, is taken from a reservoir with condensate contained therein originating in said timber.

7. Process according to claim 6, wherein any fluid not vaporized at the heating units, especially at the cooler sections of the units, is led back to said reservoir.

8. Device comprising an apparatus for drying cut timber and other plate-shaped/bar-shaped goods in a vacuum, stacked with intermediate bars in a drying chamber, provided with fans/ventilators whose effect in direction extends cross-wise to the longitudinal axis of said drying chamber so as to revolve a gaseous drying medium, and provided with a plurality of individually controlled heating units that extend along the length of said drying chamber, with a dehumidifying device and with a steam producing device, wherein said drying chamber is vacuum-tight and is divided/separated in the direction of said longitudinal axis so as to form several stack areas for said cut timber, and with a transition zone for the drying medium to pass between said several stack areas, and means in form of sensors, amplifiers and controlling/regulating devices assigned to each said stack area, to adjust the individually controlled heating units for each of said several stack areas.

9. Process according to claim 3, further including asymmetrically reversing the fans in the course of time by use of a different speed in either direction of rotation, whereby the heat transfer to that half stack area, which is preferred in time is an entrance side for said gaseous drying medium, and its flow is greater than that of the opposite half stack area.

10. Device/apparatus according to claim 8, wherein said heating units consist of a plurality of heating sections and that each said heating section has a separate valve to throttle or to cut off said heat transfer generated at each said heating section.

11. Device/apparatus according to claim 8, wherein for each said stack area at least one fan is assigned, and that by means of a suitable controlling/regulating device the adjustment of the operation conditions of each fan is available independent of other fans at any time.

12. Device/apparatus according to claim 8, adapted for use in a kiln provided with a steam producing device, and that a sprinkler pipe equipped with holes, which extend over the length of said drying chamber, is mounted adjacent to said heating units for sprinkling the units with vaporization fluid.

13. Device/apparatus according to claim 12, characterized in that said sprinkler pipe is connected via a motor pump and a supply pipe with said reservoir.

14. Device/apparatus according to claim 11, characterized in that a collecting trough is disposed below the heating units and said trough has at one end an outlet for any unvaporized fluid, which is led back to said reservoir through a drain pipe.

15. Device/apparatus according to claim 11, wherein at least one additional fan effecting flow in a length direction of the drying chamber, is mounted beside the stack areas or above an intermediate ceiling provided above said stack areas.

16. Device/apparatus according to claim 8, characterized in that a collecting trough is disposed below the heating units, and said trough has at one end an outlet for the unvaporized fluid, which is led back to said reservoir through a drain pipe.

17. Device/apparatus according to claim 8, wherein at least one additional fan effecting flow in a length direction of the drying chamber, is mounted beside the stack areas or above an intermediate ceiling provided above said stack areas.

* * * * *